US005832999A

United States Patent [19]

Ellwood

[11] Patent Number: 5,832,999

[45] Date of Patent: Nov. 10, 1998

[54] METHOD AND ASSEMBLY FOR IGNITING A BURNER ASSEMBLY

[75] Inventor: David E. Ellwood, Alpine, Tex.

[73] Assignee: Marathon Oil Company, Findlay, Ohio

[21] Appl. No.: 667,199

[22] Filed: Jun. 20, 1996

Related U.S. Application Data

[60] Provisional application No. 60/000,486 Jun. 23, 1995.

[51] Int. Cl.[6] ..... E21B 43/24

[52] U.S. Cl. ..... 166/256; 166/303; 166/59

[58] Field of Search ..... 166/59, 303, 256, 166/302

[56] References Cited

U.S. PATENT DOCUMENTS

| | | | |
|---|---|---|---|
| 3,172,472 | 3/1965 | Smith | 166/38 |
| 4,077,469 | 3/1978 | Hamrick et al. | 166/59 |
| 4,078,613 | 3/1978 | Hamrick et al. | 166/302 |
| 4,159,743 | 7/1979 | Rose et al. | 166/302 |
| 4,199,024 | 4/1980 | Rose et al. | 166/59 |
| 4,397,356 | 8/1983 | Retallick | 166/303 |
| 4,445,570 | 5/1984 | Retallick | 166/59 |
| 4,456,068 | 6/1984 | Burill, Jr. et al. | 166/303 |
| 4,459,101 | 7/1984 | Doherty | 431/353 |
| 5,163,511 | 11/1992 | Amundson et al. | 166/303 |
| 5,488,990 | 2/1996 | Wadleigh et al. | 166/260 |

OTHER PUBLICATIONS

"Trialkyl Boranes," *Technical & Handling Bulletin*, Callery Chemical Comany, Division of Mine Safety Appliances Company, Callery, Pennsylvania, (Apr. 1, 1978), pp. 1–25.

*Primary Examiner*—Frank Tsay
*Attorney, Agent, or Firm*—Jack L. Hummel; Jack E. Ebel

[57] ABSTRACT

A method and assembly for igniting a burner using a pyrophoric liquid. A quantity of pyrophoric liquid is first transported from a container to a slug launching chamber and then transporting into a fuel gas stream for the burner. The slug launching chamber is flushed with a hydrocarbon liquid to remove any of the quantity of pyrophoric liquid from the launching chamber, while the assembly can be purged with an inert gas prior to removing the pyrophoric liquid container and replacing it with a new container.

19 Claims, 9 Drawing Sheets

METHOD AND ASSEMBLY FOR IGNITING A BURNER ASSEMBLY

This application claims the benefit of U.S. Provisional Application No. 60/000,486 filed on Jun. 23, 1995.

BACKGROUND OF THE INVENTION

1. Field of tie Invention

The present invention relates to a method and assembly for operating a burner which is positioned within a subterranean well, and more particularly, to a method and assembly for igniting such a downhole burner.

2. Description of Related Art

It is a common oil field practice to inject gas into an oil reservoir for pressure maintenance. Relatively inexpensive gas may be added to a reservoir at sufficient rates to increase reservoir pressure resulting in an increased oil production rate while reducing or eliminating aquifer influx and associated water production. Accomplishing a significant pressure increase requires that a large, cost effective, source of inert gas be available. Under some circumstances, it is desirable to heat the injected gas. For example, heat has been used to increase the mobility of the oil by decreasing the viscosity of the oil in the formation, increasing the volume of the oil, or increasing the rate of imbibition of flooding fluids. Thus, it is more efficient to heat the gas inside the well, adjacent to the formation into which the gas is to be injected, by means of a burner.

Previous burners have used electrical igniters to start combustion within the well, which requires that electrical wires be run alongside the fuel gas and oxidizer tubing down to the burner, thus requiring that the wires penetrate any packer device used to prevent reservoir fluids from flowing back up the well. These electrical wires are a source of leakage of the packer device. Further, the relatively long length of wire necessary to reach the burner from the surface results in a significant loss of amperage. Additionally, the short useful life of spark plug(s) which are utilized in the igniter necessitates pulling the entire burner from the well to replace the plug(s). Thus, a need exists for a method and assembly for more efficiently and safely igniting a burner positioned with a subterranean well bore.

Accordingly, it is an object of the present invention to provide a method and assembly for igniting a downhole burner using a pyrophoric liquid.

It is another object of the present invention to provide a such method and assembly for igniting a downhole burner using a pyrophoric liquid which is efficient and safe.

It is still another object of the present invention to provide a method and assembly for igniting a burner positioned within a subterranean well bore which eliminates the need for electrical wires to be positioned within a well bore and the attendant difficulties therewith.

It is a further object of the present invention to provide a method and assembly for igniting a downhole burner using a pyrophoric liquid which minimizes both the handling of and exposure of personnel to the pyrophoric.

It is a still further object of the present invention to provide a method and assembly for igniting a downhole burner using a pyrophoric liquid which minimizes the amount of pyrophoric liquid necessary to achieve ignition of the burner assembly.

SUMMARY OF THE INVENTION

To achieve the foregoing and other objects, and in accordance with the purposes of the present invention, as embodied and broadly described herein, one characterization of the present invention is a method for igniting a burner using a pyrophoric liquid which comprises transporting a quantity of pyrophoric liquid to a slug launching chamber, transporting the quantity of pyrophoric liquid from the slug launching chamber into a fuel gas stream for the burner, and flushing the slug launching chamber with a hydrocarbon liquid to remove any of the quantity of pyrophoric liquid from the launching chamber.

In another characterization of the present invention, an assembly is provided for for igniting a burner using a pyrophoric liquid. The assembly comprises a conduit for transporting a fuel gas to the bumer, a chamber having an upper end and a lower end, and a vessel for storing pyrophoric liquid which vessel is in fluid communication with the chamber.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENTS

Figure 1:
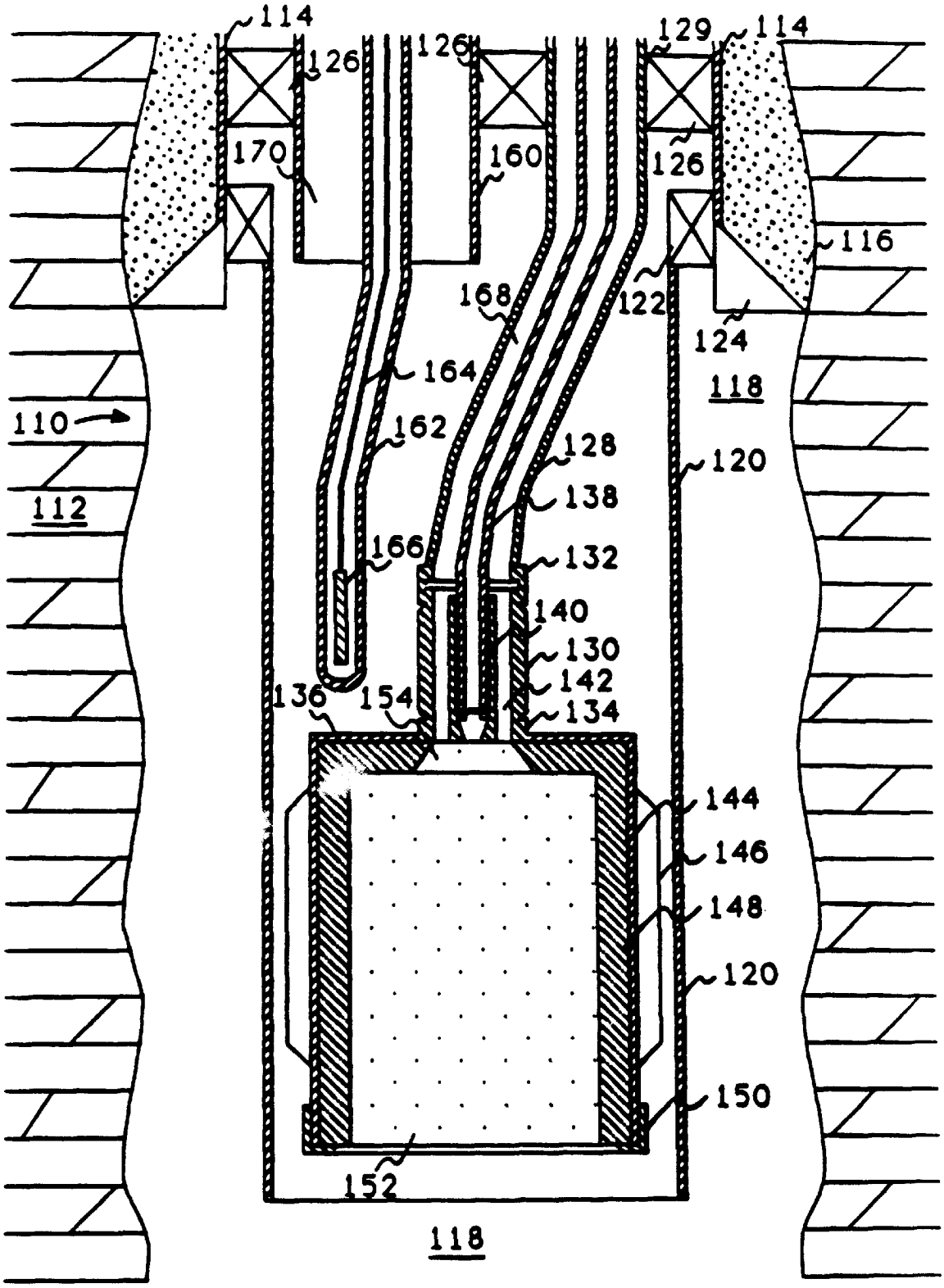
FIG. 1 is a perspective view illustrating one embodiment of a burner, partially sectioned to illustrate a well extending into a subterranean injection zone.

One downhole burner developed for generating and heating gas inside a well is described in commonly assigned U.S. patent application Ser. No. 081308,021 which was filed on Sep. 16, 1994 and is incorporated herein by reference. As illustrated in FIG. 1, a well 110 penetrates a subterranean formation 112 and has an open or cased hole completion. A production casing 114 extends to the top of the formation and is cemented to the wall of the well by a cement bond 116. Adjacent the open hole interval 118, if required, is a casing liner 120, hung from the casing by casing liner hanger 122 at casing shoe 124. A dual bore packer 126 provides a seal between the open hole interval 118 and the cased portion of the well. The packer serves to prevent backflow of combustion products up the well.

A first tubing string 128 passes through a first bore 129 of the dual bore packer 126 and is connected to the upper end of burner nipple 130 by tubing collar 132. The lower end of burner nipple 130 is connected to a threaded top collar 134 of a burner assembly 136. A first coil tubing string 138 extends inside the fist tubing string 128 from the wellhead through a coil tubing seal assembly 140 in the burner nipple 130 to the top collar of the burner assembly 136. Between the wall of the burner nipple 130 and the coil tubing seal assembly 140 are a plurality of passages 142.

The burner assembly 136 has an outer shroud 144. Preferably, the shroud is made from a high-temperature alloy. Centralizer vanes 146 ensure that the burner assembly is centralized with the casing liner 120, or formation 112, and also provide additional surface area for heat exchange. A removable refractory liner 148 floats within the shroud 144 and is held in place by a refractory retainer ring 150. Inside the liner a combustion chamber 152 is open on the bottom to the lower portion of the casing liner 120. An inlet 154 at the top of the assembly connects the passages 142 and the end of the coil tubing to top of the combustion chamber 152.

A second coil tubing string 162 is located inside the second tubing string 160. Within the second coil tubing string a wire 164 connects an instrument 166 with readout equipment at the surface. The instrument shown is a thermocouple, but other instruments could be placed within the second coil tubing string.

In a method for maintaining pressure in and heating a subterranean formation, an oxidizing gas flows from the surface through a first annulus 168 between the first tubing string 128 and the first coil tubing string 138, through air passages 142 in the burner nipple 130, and into the top of the combustion chamber 152 of the burner assembly 136. Air is the preferred oxidizing gas, however, oxygen enriched air can also be used.

Fuel gas flows inside the first coil tubing string 138 from the surface to the burner assembly and into the top of the burner assembly via inlet 154. The fuel gas may be any hydrocarbon or mixture of hydrocarbons, ranging from methane to diesel. As will be apparent to those skilled in the art, an appropriate nozzle is used when the fuel gas is a liquid. The preferred fuel gas is a mix of methane and other gases, since high pressure combustion provides an opportunity to fuel the burner with low BTU gas of low value. The fuel gas and the air are mixed in the upper portion of the combustion chamber 152. The concentric arrangement of the tubing improves mixing of the gases.

A pyrophoric fluid, such as triethyl borine or sodium bromide, is mixed with the fuel gas as hereinafter described. The pyrophoric fluid ignites when it contacts the air below the burner nozzle. Combustion occurs at a temperature of approximately 3700° F.

An coolant gas flows under pressure through a second annulus 170 between the second tubing string 160 and the second coil tubing string 162 from the surface to the open hole section of the well. As the coolant gas flows past the burner assembly 136, the assembly 136 and the centralizer vanes 146 function as a heat exchanger, the combustion products and the burner assembly 136 are cooled by the coolant gas while the coolant gas is heated. Higher temperatures increase the rate of corrosion of the downhole hardware. Thus, it is preferred to have at least six centralizer vanes 146 to promote heat exchange. However, the minimum length of the burner assembly limits the quantity of heat exchanged through the burner wall and centralizer vanes. Hot exhaust gas mixes with the coolant gas before they reach a common temperature. The heated coolant gas mixes with the exhaust gas exiting the bottom of the combustion chamber 152, and the gas mixture is injected into the open hole interval 118 of the formation.

The cooling gas can be any composition. Preferably, the coolant gas is comprised of produced gas and combustion products containing no more than 1 wt % $O_2$ to avoid increased corrosiveness of formation gas. Combustion cannot occur in formation due to dilution of already low $O_2$ concentration, however, an oxidation reaction may occur. A combustible mixture will only exist within the burner chamber. Preferably, the coolant gas contains essentially no $O_2$. However, a small amount of $O_2$ will react with the coolant gas in the well. The gases are supplied at flow rates such that the coolant gas/combustion products mixture is injected into the formation at a pressure in excess of the formation pressure. Preferably, the gas mixture is injected into a subterranean formation that is competent and has a high fluid conductivity. For example, the formation could have a network of open fractures. Preferably, the well has an open hole completion. However, the well could be cased if the cement used to secure the casing to the wellbore wall can withstand the high temperatures accompanying the combustion method of this invention. Gas injection can be continuous or intermittent.

When the burner is be used for enhancement of an in situ combustion method, especially in a fractured, hydrocarbon-bearing subterranean formation, the burner is positioned within well 110 adjacent the subterranean, hydrocarbon-bearing formation of interest and operated as described above until a temperature is reached, for example 500° F., which is sufficient for spontaneous reaction of hydrocarbons present in the formation. The term "spontaneous reaction" as utilized herein is inclusive of chemical oxidation or combustion. The coolant gas in this embodiment is also a combustion supporting gas, preferably air or oxygen enriched air. This coolant gas is superheated by operation of the burner to temperatures well above the temperature necessary to sustain the spontaneous reaction of hydrocarbons in the formation, for example about 600° F. to about 1000° F. Once hydrocarbons within the formation become reactive, the continuous injection of superheated, coolant gas into the formation supplies the reactant necessary to maintain such spontaneous reaction and to propagate the reaction front radially, outward from the well. By superheating the coolant gas within the well and adjacent the formation of interest, the coolant gas also serves to continuously maintain the temperature of the in situ combustion system within the formation so as to maintain the reactivity of hydrocarbons while propagating the in situ reaction front further away from the well. Because the coolant gas is superheated, substantially all hydrocarbons present in the formation, primarily the less valuable, residual heavy ends which are not normally produced, will be consumed as the front of an in situ combustion reaction passes through the formation. Given the relative absence of combustible hydrocarbons present in a portion of the formation after the combustion front has passed through, significant portions of the coolant gas being injected into the formation during an in situ combustion operation will be transported to the combustion front thereby effectively and efficiently enhancing the growth of the zone of reactivity from the well. In this manner, the use of the burner of the present invention to initiate and propagate an in situ combustion method in a subterranean formation, especially a fractured formation, efficiently enhances the method in a cost effective manner. It is preferred that the in situ combustion method set forth above be conducted in a well which is completed open hole, i.e. that is not cased. However, the well can be cased if the metallurgy of the casing is chosen to withstand extended periods of burner operation with oxygen enriched coolant gas.

Figure 2:
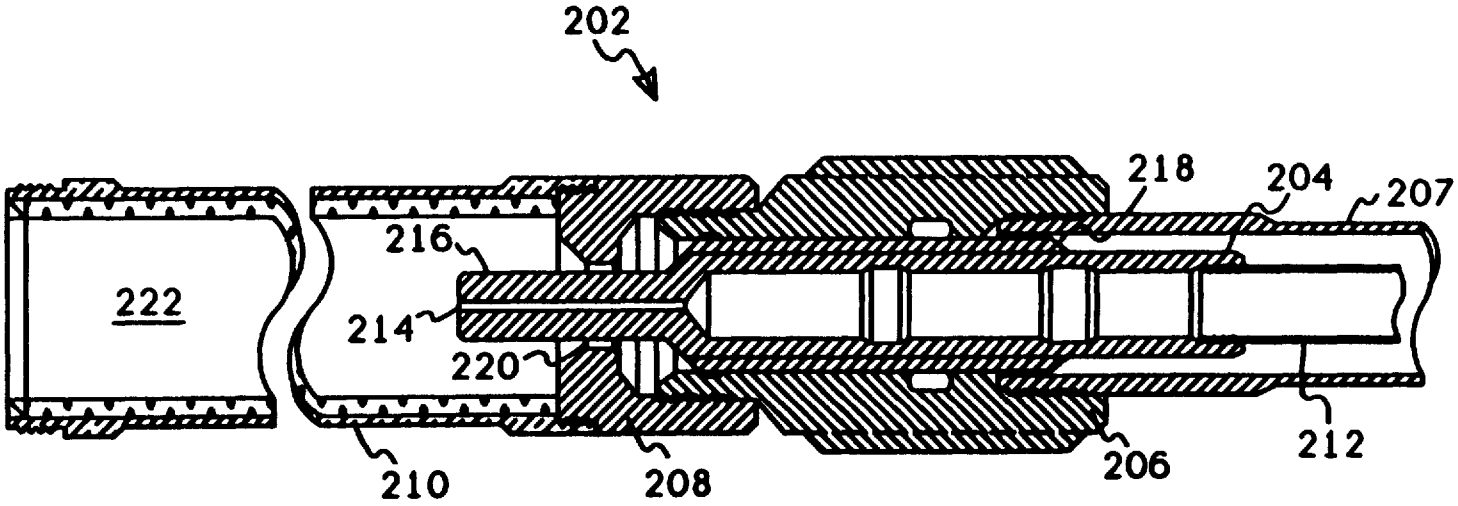
FIG. 2 illustrates a second embodiment of a burner, including the burner and supporting hardware.

FIG. 2 shows a second embodiment of the bumer. Referring now to FIG. 2, a burner assembly 202 has a burner nozzle 204 contained within a burner nipple 206. The burner nipple 206 is attached to a first tubing string 207, which conducts oxidizing gas, typically air, from the surface of the well to the burner assembly 202. The burner nipple 206 is also connected to a burner shroud 208 which surrounds the downhole end of the burner nozzle 204. Attached to the burner shroud 208 is a burner shroud extension 210 which extends beyond the end of the burner nozzle 204 to contain the flame.

A coil tubing string 212 is concentrically arranged within the first tubing string 207 such that the coil tubing 212 is attached to the nozzle 204. The coil tubing 212 conducts fuel, typically methane gas, to the burner nozzle 204. The fuel passes through the nozzle 204 and exits through a small orifice 214 within an elongated nozzle end 216 attached to the nozzle body of the nozzle 204.

Centralizing vanes 218 attached to the burner nozzle 204 center the nozzle 204 within the burner nipple 206 and allow air contained within the first tubing string 207 to flow around the burner nozzle 204 and exit through an orifice 220 into the burner shroud extension 210. The orifice 220 is formed between the nozzle end 216 and an opening in the burner shroud 208 through which the nozzle end 216 is inserted. The orifice 220 is designed to be small in size to increase the velocity of the air exiting the burner shroud 208 into the combustion chamber 222. Also, the orifice 214 in the burner nozzle end 216 of the nozzle 204 is small to increase the velocity of the fuel gas as it exits the orifice 214. The combination of increased fuel gas velocity from the orifice 214 and increased air velocity through orifice 220 causes the flame front to be well down into the burner shroud extension 210 and prevents migration of the flame front back through either the nozzle 204 or back through the shroud 208. Positioning the flame front further down the shroud reduces the heat transfer across the shroud and centralizer vanes and the exhaust gas temperature is higher.

The burner nozzle end 216 is elongated to allow for expansion differences between the first tubing string 207 and the coil tubing 212. The elongation of burner nozzle end 216 allows the first tubing string to expand during operation while keeping the orifice 214 below the shroud 208, thus keeping the flame front below the shroud 208. The length of the nozzle end is determined by the difference in expansion that can occur between the first tubing string 207, including the burner nipple 206 and burner shroud 208, and the coil tubing string 212, including the nozzle 204 and burner nozzle end 216. This difference is determined by the material used to construct the devices, and the length of the two tubing strings.

Figure 3B:
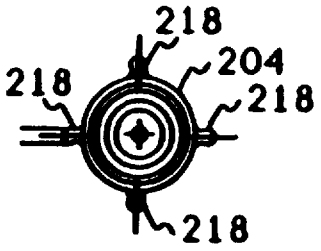
FIGS. 3A and 3B illustrate side and end views of the burner of the second embodiment.
Figure 3A:
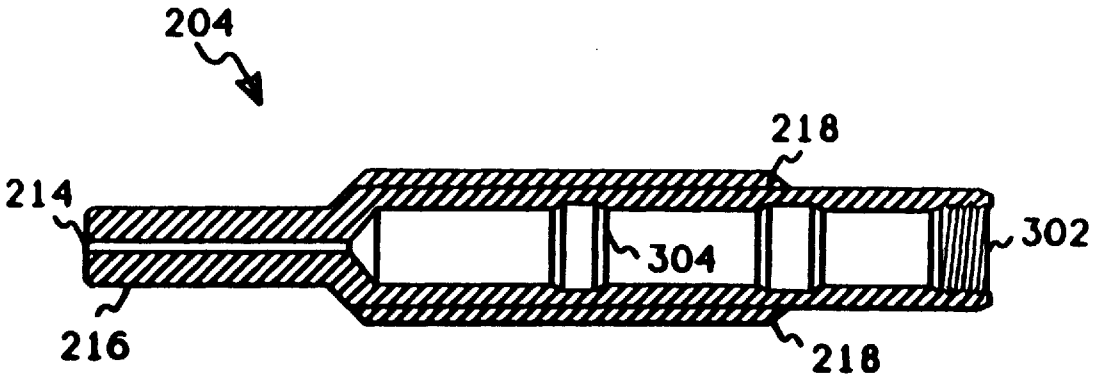

FIGS. 3A and 3B show a more detailed view of the burner nozzle 204 of FIG. 2. FIG. 3A shows a more detailed side view of the burner nozzle 204, and FIG. 3B shows an end view of the burner nozzle 204. Referring now to FIGS. 3A and 3B, the burner nozzle 204 is shown having the orifice 214 in the burner nozzle end 216 of the nozzle 204. Centralizing vanes 218 are shown on the sides of the nozzle 204 and are better shown in FIG. 3B. In the preferred embodiment, there are four centralizing vanes 218 oriented at 90° angles with respect to each other to support and center the nozzle 204 within the nipple 206 (FIG. 2) while allowing air to pass around the nozzle 204, through the burner shroud 208 (FIG. 2) and out through the orifice 220 (FIG. 2). The nozzle 204 contains threads 302 that mate with the coil tubing string 212 (FIG. 2) to conduct fuel gas through the nozzle 204 and out through the orifice 214. A landing nipple profile 304 is constructed to allow a wireline plug to be placed within the nozzle 204 so that the assembly can be inserted into a well without having to "kill" the well before the insertion. This has the added advantage of lower cost for inserting the burner into the well, as well as less damage to the formation containing the well.

Figure 4B:
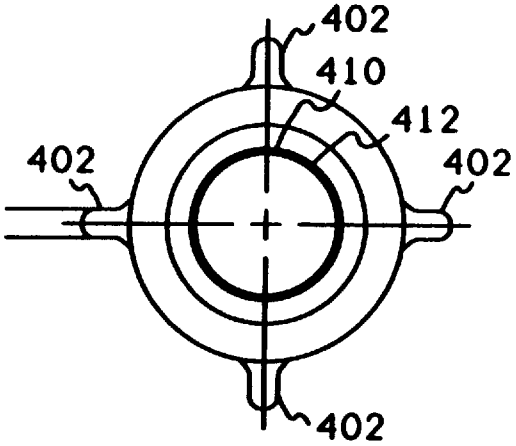
FIGS. 4A and 4B illustrate side and end views of a burner nipple used to connect to the first tubing string and to contain the burner of the second embodiment.
Figure 4A:
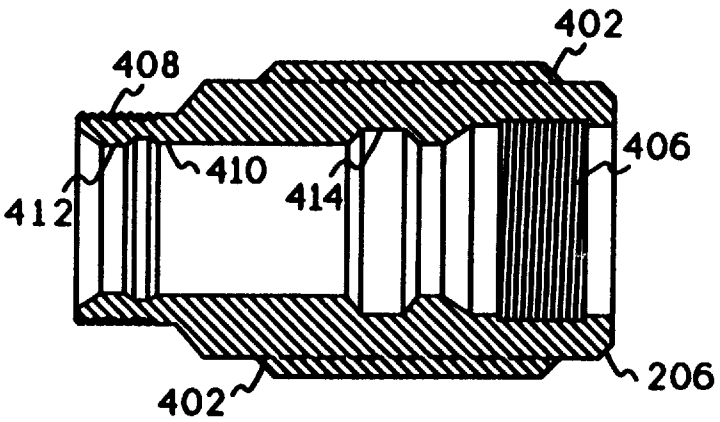

FIGS. 4A and 4B show a more detailed diagram of the burner nipple 206 of FIG. 2. FIG. 4A shows a more detailed side view, and FIG. 4B shows an end view of the burner nipple 206. Referring now to FIG. 4, the burner nipple 206 contains centralizing vanes 402 which operate in a manner similar to the centralizing vanes 218 on the nozzle 204. In the preferred embodiment, there are four centralizing vanes 402. The centralizing vanes 402 support and center the burner nipple 206 within a well casing liner (shown in FIG. 6 below) and permit the flow of coolant gas around the burner nipple 206 down past the shroud 208 and the shroud extension 210 to be mixed with the exhaust gases as they exit from the combustion chamber 222 (FIG. 2) of the shroud extension 210 (FIG. 2). Threads 406 allow the burner nipple 206 to mate with the tubing string 207 (FIG. 2), and threads 408 allow the burner nipple 206 to mate with the burner shroud 208 (FIG. 2).

The inside diameter 410 of the burner nipple 206 is large enough to accommodate the centralizing vanes 218 of the nozzle 204, however, the inside diameter 412 at the end of the burner nipple 206 is smaller than the inside diameter 410 and is not large enough to allow the vanes 218 of the burner nozzle 204 to pass. Therefore, the diameter 412 forms a no-o section which stops the passage of the burner nozzle 204 through the burner nipple 206. This allows the burner nozzle 204 to be passed down through the tubing string 207 and to be seated into the burner nipple 206 without passing beyond the burner nipple 206 and into the bottom of the well.

Figure 5:
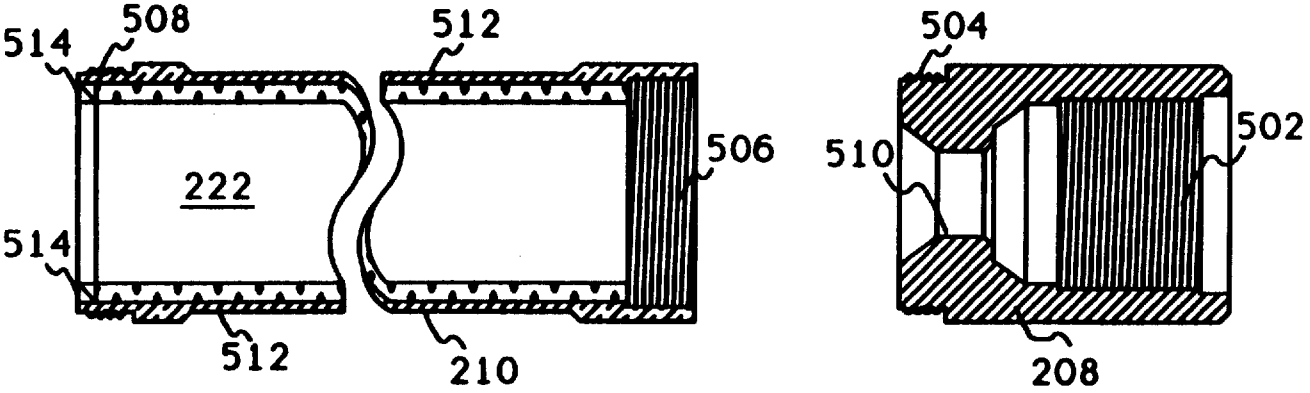
FIG. 5 illustrates a burner shroud and shroud extension of the second embodiment that is used to contain the combustion gases before they are mixed with the coolant gases.

FIG. 5 shows a more detailed drawing of the burner shroud 208 and burner shroud extension 210 of FIG. 2. Referring now to FIG. 5, the burner shroud 208 contains threads 502 that mate with threads 408 of the burner nipple (FIG. 4), to connect the shroud 208 and the nipple 206. Bumer shroud 208 also contains threads 504 which mate with threads 506 of the burner shroud extension 210. The burner shroud extension 210 also contains threads 508 which would mate with threads 506 of a second burner shroud extension if such an extension is desired. In this manner, the burner shroud extension can be extended to any length desired to ensure complete combustion of the fuel and air mixture before allowing dilution of the combustion product with the residue gas.

As discussed above with respect to FIG. 2, the inside diameter 510 of the burner shroud 208 is larger than the outside diameter of the burner nozzle end 216 of the burner nozzle 204 (FIG. 2). The difference between these two diameters creates a concentrically arranged orifice with an area small enough to deliver a combustion air velocity high enough to prevent migration of the flame front back into the burner shroud or the burner nipple. In the preferred embodiment, the concentrically arranged orifice 220 has an area of approximately 0.018 square foot which creates a combustion air velocity of greater than 100 feet per second with a surface pressure of 650 pounds per square inch.

The burner shroud 210 is designed to contain the majority of the heat generated from the combustion reaction and is therefore constructed from a heat resistant alloy, for example INCONEL alloy 601. A removable refractory liner 512 floats within the shroud 210 and is held in place by a refractory retainer ring 514. The refractory liner is made of Greencast 97 or equivalent, and the retainer ring is made of a high temperature alloy. The combustion chamber 222 is open on the bottom of the shroud extension 210 to let combustion gasses out into the formation.

Figure 6A:
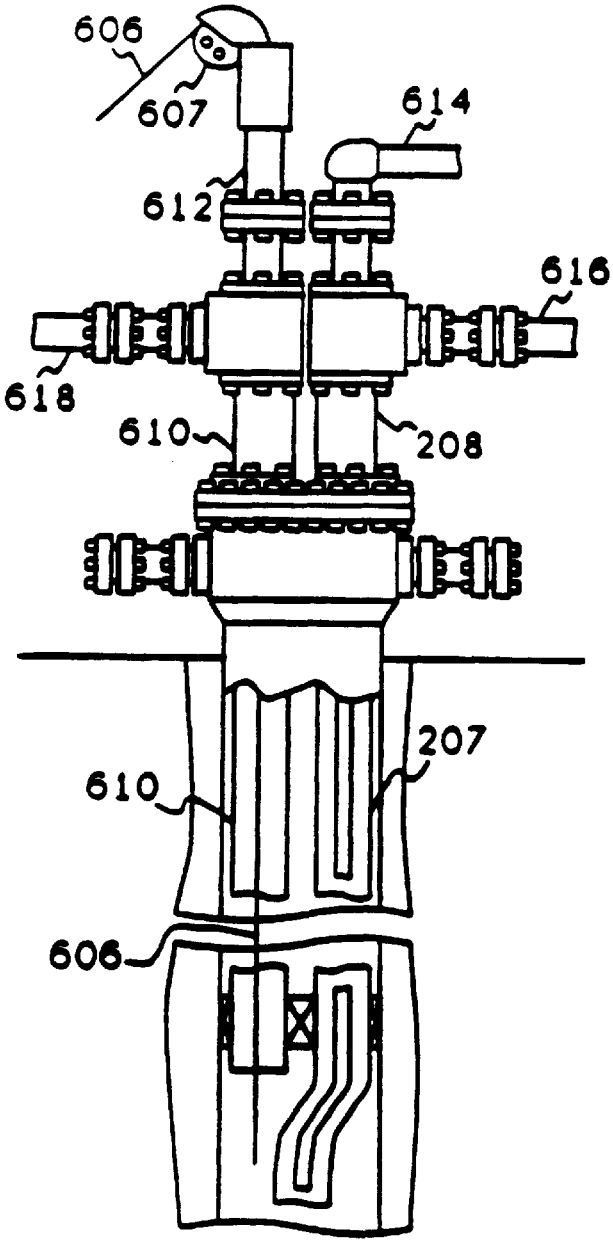
FIGS. 6A and 6B illustrate an overview of how the burner of the second embodiment operates within a well.
Figure 6B:
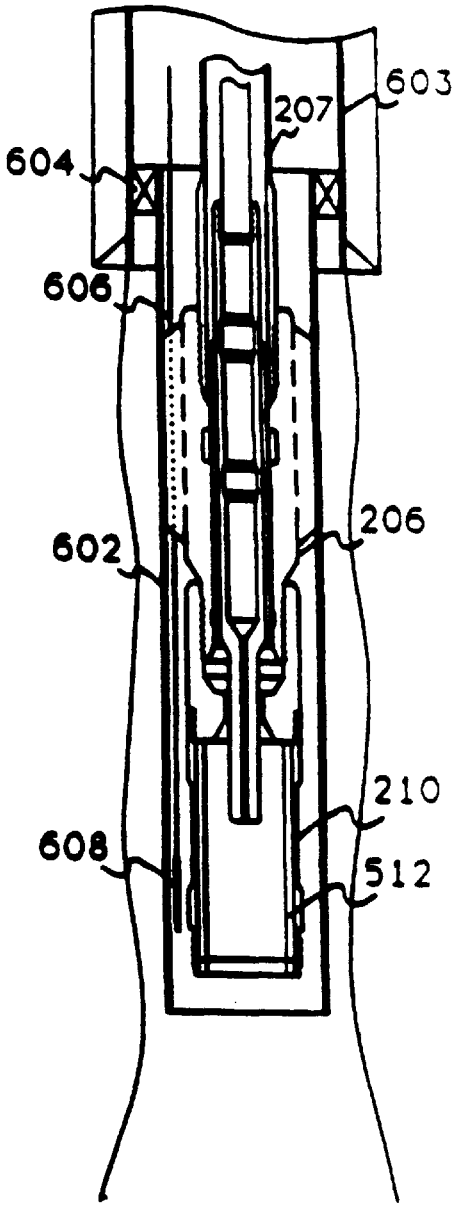

FIGS. 6A and 6B show a diagram of the burner inside a well. FIG. 6A shows the top portion of the well, and FIG. 6B shows the bottom portion of the well. Referring now to FIG. 6, the burner nozzle 204 is shown contained at the end of the first tubing string 207, and attached to the coil tubing string 212 which delivers fuel to the nozzle 204. The nozzle 204 is contained within the nipple 206 which is centered within a casing liner 602 by the centralizing vanes 402. The liner 602 is attached to the well casing 603 by means of a liner hanger 604.

Fuel enters the first tubing string 207 through connecting pipe 614 and flows down through coil string tubing 212 to the burner nozzle 204. Air enters the first tubing string 207 through connecting pipe 616, flowing around coil string tubing 212, around nozzle 204 and into the burner shroud extension 210.

A second tubing string 610 conveys coolant gas from the surface down to the burner. The coolant gas enters the second tubing string 610 through connecting pipe 618. The coolant gas flows through the second tubing string 610 and exits the second tubing string 610 above the liner hanger 604. The coolant gas then flows through casing liner 602 on the outside of the burner nipple 206, around the centralizing vanes 402, and on the outside of the burner shroud 210 to cool the burner shroud. The liner may not be required in certain formations. The coolant gas then mixes with the combusted exhaust gases exiting the burner shroud 210 and both flow into the formation.

Extending down through the coolant gas tubing string 610 is a wire 606 containing electrical connections for a thermocouple 608, or other device. The wire 606 extends out through the top of the well through a pulley 607 that allows the thermocouple or other device to be raised and lowered alongside the burner to measure temperatures at various points along side the burner.

Figure 7:
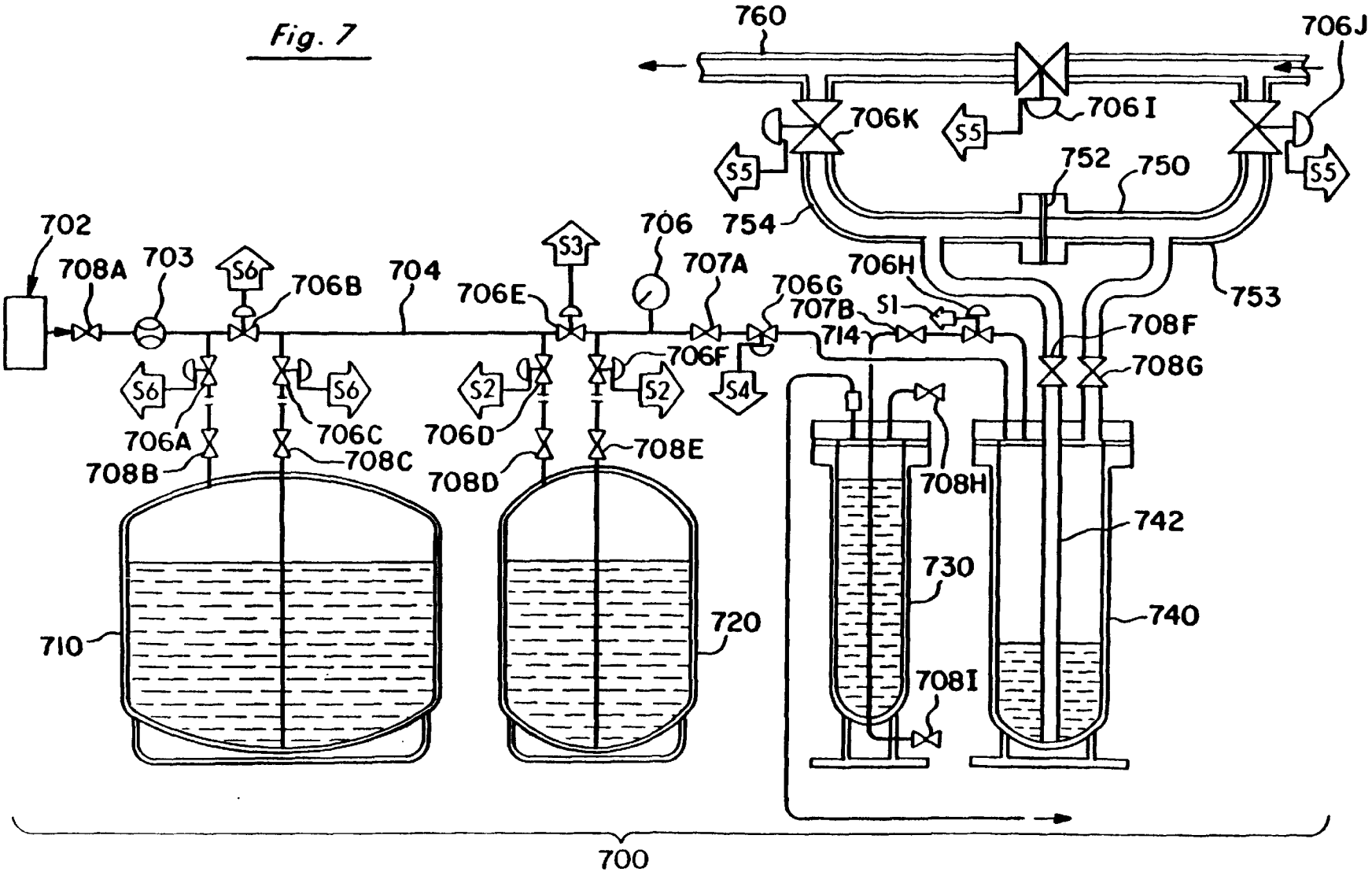
FIG. 7 is a diagrammatic flow diagram of one embodiment of the assembly of the present invention which is utilized to igniting a downhole burner assembly using a pyrophoric liquid.
Figure 8:
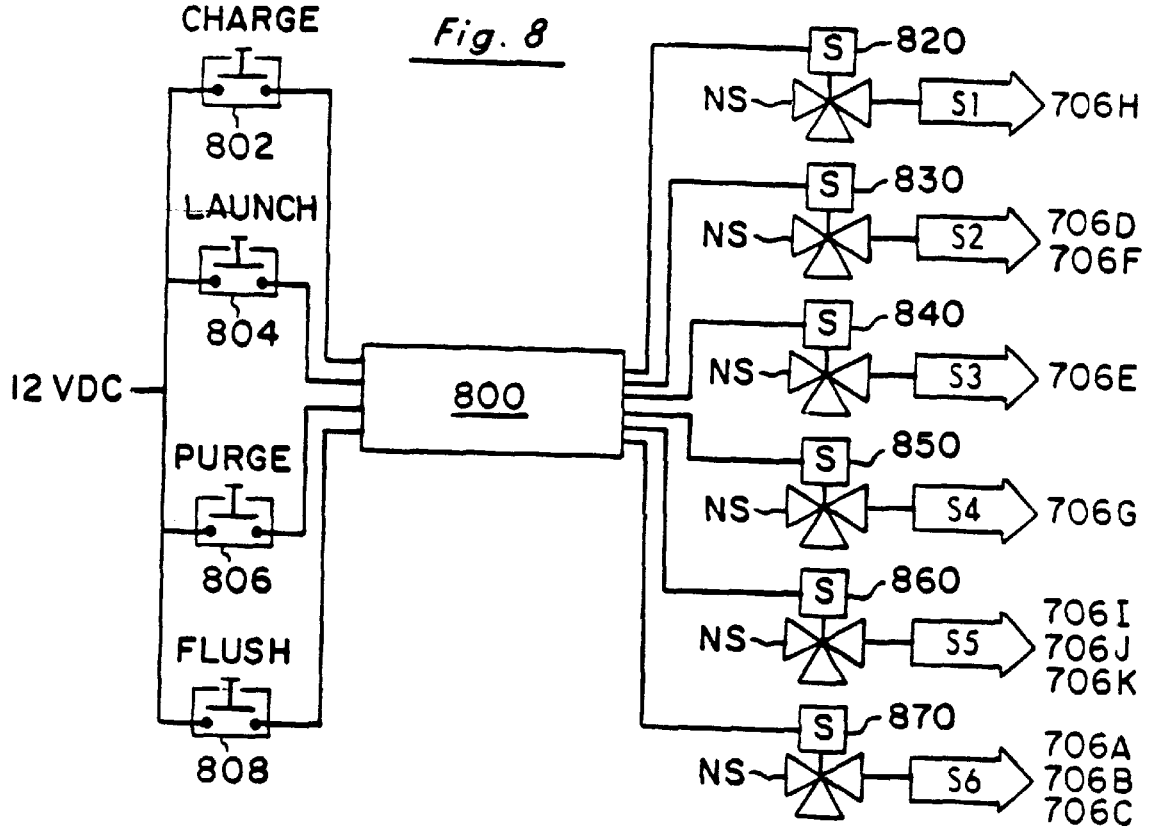
FIG. 8 is schematic illustration of the control system utilized in conjunction with the embodiment of the assembly of the present invention which is illustrated in FIG. 7.

In accordance with the present invention, ignition of a downhole burner is accomplished by injecting a quantity of a pyrophoric liquid, for example triethylborane (TEB), into the fuel gas stream of the burner. A method for injecting a metered quantity of a pyrophoric liquid, such as TEB, into the fuel stream which is transported via coil tubing string 138 or 212 the assembly which is located at the surface of the earth and which is utilized to practice such method are hereinafter described. Referring now to FIG. 7, the assembly of the present invention is illustrated generally 8 700 and has an inert gas supply 702, pressure regulator 703, a liquid hydrocarbon storage tank 710, a pyrophoric liquid storage vessel 720, a slug launching chamber 740, and a vent gas scrubber 730. The components of the assembly are interconnected by means of tubing 704, for example ¼ "stainless steel tubing, pneumatic actuated bellows valves 706 A–K and manual bellows valves 708 A–I. Additional equipment required are pressure gages 705, pressure sending units S1–6 (FIG.8), instrument housing (not illustrated), and metering valves 707 A, B for rate control. As illustrated in FIG. 8, a programmable method logic controller 800 receives signals from four panel mounted push buttons 802, 804, 806 and 808 and provides control logic to six electric solenoid actuated three-way pneumatic control valves 820, 830, 840, 850, 860, and 870. Each three way valve controls one or more of the pneumatic actuated bellows valves. The high pressure injection system consists of the slug launching chamber 740, orifice loop 750, control valves 706 I–K, manual valves 708 G and F and the fuel gas line 760 to the wellhead. All control gas, blanket gas, etc., will be nitrogen.

The pyrophoric liquid, e.g. TEB, is shipped by the manufacturer under a nitrogen blanket gas in a DOT 4 BA low pressure gas cylinder rated to 240 psig service pressure. The TEB injection system must be thoroughly purged with a suitable gas, for example nitrogen, prior to and during connection of the TEB cylinder. Once connected, the TEB cylinder should not be disconnected until the injection system is purged with nitrogen. Once purged, any remaining TEB can be diluted to a safe level by flushing with a suitable hydrocarbon liquid, for example diesel or naphtha. Furthermore, before any well work is performed, the fuel line which may be constructed of any suitable tubing, for example 1.5" coil tubing, must be thoroughly flushed with diesel or naphtha to prevent ignition of TEB during workover operations.

In accordance with the present invention, a method is provided for transferring and handling of a pyrophoric liquid, such as TEB. Initially, TEB is transferred from the shipping container, for example a DOT 4-BA container, to the slug launching chamber. To charge, the charge button is pressed actuating valve 706H. This allows any high pressure gas that may have been trapped from previous ignition attempts to escape from the slug launching chamber. The gas escapes the slug launching chamber through the vent line 714 into the vent gas scrubber 730. The vent gas scrubber contains a suitable liquid, for example a 3% aqueous ammonia or methanol solution, to remove any traces of TEB before the gas is vented to atmosphere a safe distance from personnel or equipment. Valve 706H remains open to vent the slug launching chamber 740 during the remaining charge operation.

Once the slug launching chamber 740 is blown down to atmospheric pressure, a permissive signal is sent to the programmable logic controller 800, actuating valves 706 D, E, F and G, allowing nitrogen pressure to force TEB up the siphon tube 704, through metering valve 707A, and into the slug launching chamber 740. The amount of TEB transferred is controlled by variation of the time at which valves 706 D, E, F and G are actuated. When a sufficient amount of TEB is transferred to the slug launching chamber, valves 706D and F fail dosed and 706E fails open, isolating the TEB shipping container and allowing nitrogen to continue to purge the delivery line into slug launching chamber 740. After the delivery line is purged, valves 706 G and H are failed or closed, completing the low pressure delivery of TEB to the slug launching chamber.

To launch the slug of TEB from the slug launching chamber into the fuel gas line 760 in accordance with the method of the present invention, the launch button 804 is pressed actuating valves 706 I, J and K In this manner, the fuel gas stream is diverted into orifice loop 750 which has an orifice 752 positioned therein. Orifice 752 has sufficient restriction to create a pressure differential between the upstream side 753 (high pressure) and the downstream side 754 (low pressure) in orifice loop 750.

The high pressure from the upstream side 753 of orifice loop 750 fills the slug launching chamber and forces TEB up the siphon tube 740 to the low pressure side 754 of orifice loop 750 where TEB is swept into the fuel stream in fuel gas line 760. When this transfer is complete, valve 706 I is failed open and 706 J and K are failed closed, returning the fuel gas stream to its normal path. The valve 706H is opened until high pressure is bled off slug launching chamber 740.

The system should then be flushed with a suitable hydrocarbon liquid, for example methanol, diesel, or naphtha fed from tank 710, to remove any traces of TEB before disconnecting the device from the wellhead or opening up any component or tubing for service. The effluent can then be injected into the fuel gas stream to be burned in the downhole burner.

To flush the system, the flush button 808 is pressed, actuating valves 706 A, B, C, G and H until a sufficient volume of hydrocarbon liquid has flushed the delivery line and system into the slug launching chamber 740. Valves 706 A, C, G, and H are then failed closed and valve 706B is failed open. Then valves 706 I, J, and K are actuated to launch the effluent into the fuel gas line 760. After the effluent is launched into the fuel gas line, valve 706 I is failed open and J and K are failed closed. Valve 706H is then opened to bleed off the pressure from the slug launching chamber 740, through the vent gas scrubber 730 to the atmosphere. Once the slug launching chamber 740 is bled down, valve 706H fails closed.

Before disconnecting the injection assembly from the TEB shipping container, the assembly should be purged with nitrogen to minimize the possibility of a TEB release at the shipping container connections and the attendant safety problems associated therewith. Nitrogen will purge the system sufficiently to remove the TEB container for replacement with a full container. To purge the system with nitrogen, the purge button 806 is pressed, actuating valves 706 D, F, G and H, and clearing the connections to the shipping container and delivery line of TEB. Upon completion of the purge, valves 706 D, F, G and H are failed dosed.

Figure 10:
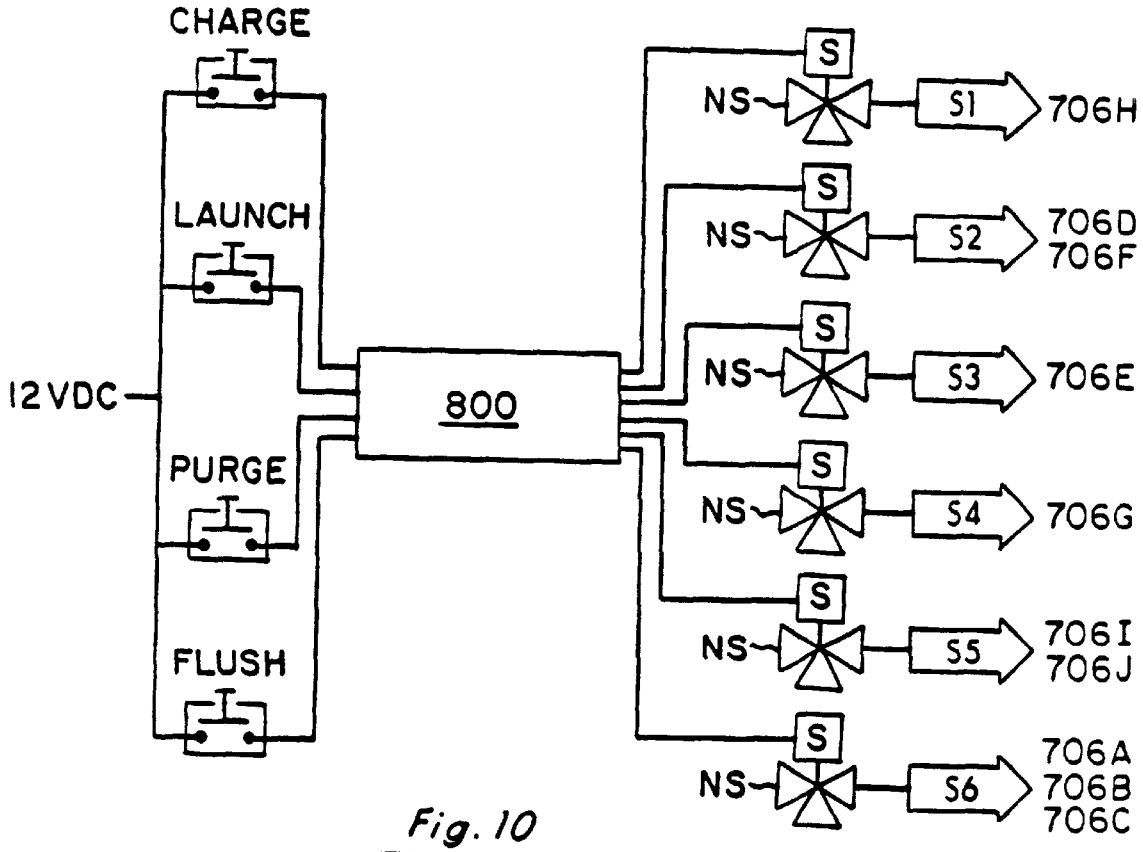
FIG. 10 is schematic illustration of the control system utilized in conjunction with the embodiment of the assembly of the present invention which is illustrated in FIG. 9.
Figure 9:
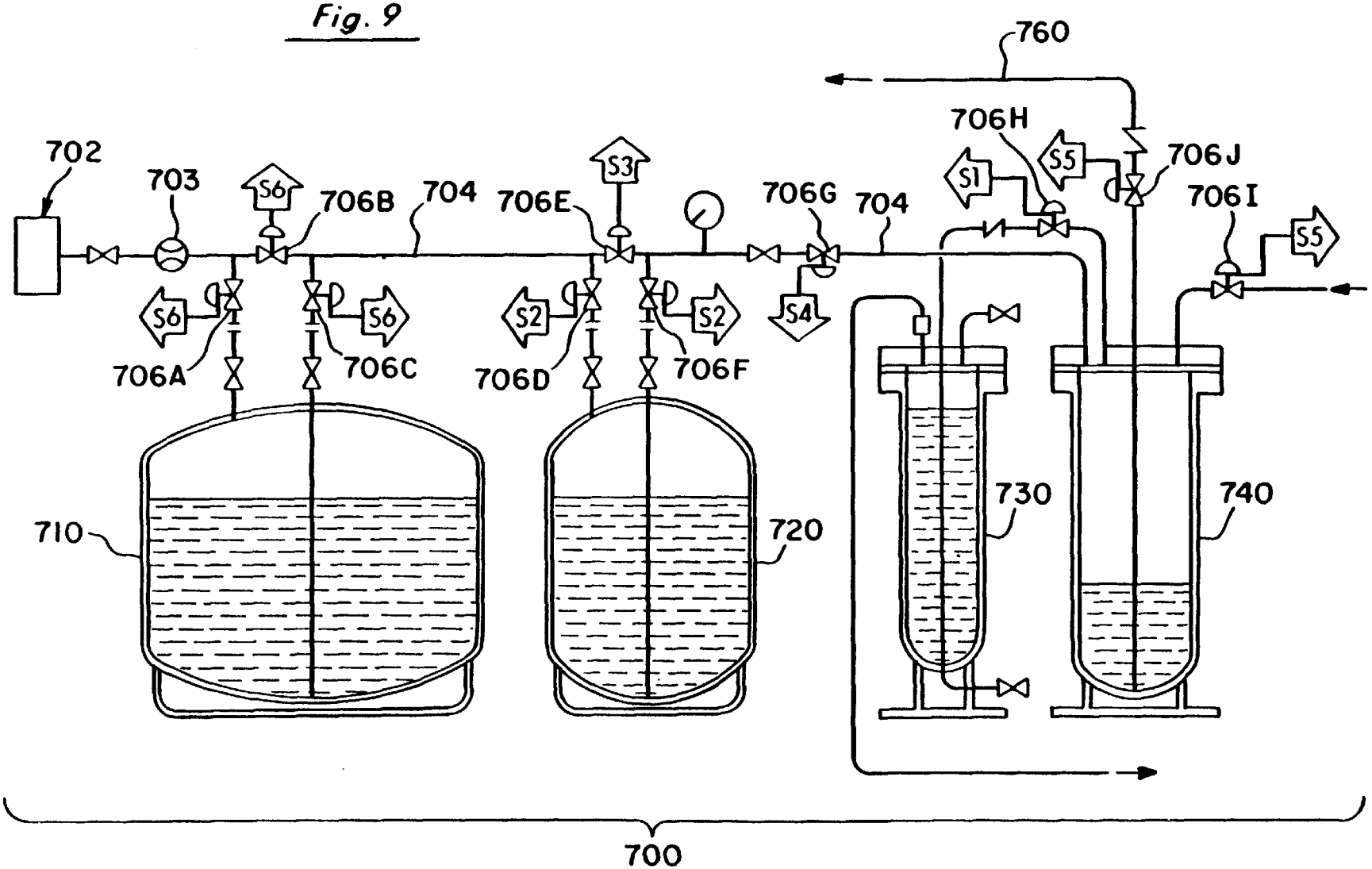
FIG. 9 is a diagrammatic flow diagram of another embodiment of the assembly of the present invention which is utilized to igniting a downhole burner assembly using a pyrophoric liquid.

An alternative embodiment of the pyrophoric liquid injection system or assemblage of the present invention is illustrated in FIG. 9. In accordance with this embodiment, the fuel bypass loop is eliminated. In place of the bypass loop, the slug launching chamber 740 is pressurized with, for example 500 PSI of nitrogen. The outlet of the slug launching chamber 740 is connected by tubing 760 directly to the wellhead and the TEB is injected into the fuel line, e.g. coil tubing 138 or 212, at or near the well head. It is within the scope of the present invention to connect the tubing 760 leading from the slug launching chamber to the fuel line at a point within the well in which the downhole burner is positioned. To launch the slug of pyrophoric liquid, e.g. TEB, from the slug launching chamber into the fuel stream in accordance with this embodiment, the launch button is pressed actuating valves 706 I and J. This pressures up the slug launching chamber to the fuel stream pressure and forces TEB up the siphon tube, through the line 760 to the wellhead where the TEB is injected into the fuel line, e.g. coil tubing 138 or 212. After the launch is complete, valves 706 I and J are failed dosed. Valve 706 H is then opened until high pressure is bled off the slug launching chamber. The remaining description set forth above with respect to operation of the embodiment of FIG. 7 applies to FIG. 9 except that all references to valves 706I, J and K is change to valves 706 I and J. This change is reflected in the control system schematic illustrated in FIG. 10.

A pyrophoric liquid, such as triethylborane (TEB), ignites immediately when exposed to air and thereby provides an ignition source for any fuel leaks that may occur at the surface. Thus, fire hazards are of prime concern. Accordingly, the apparatus of the present invention minimizes both the handling of and exposure of personnel to pyrophoric liquid(s).

Pyrophoric liquids, such as TEB, are compatible with many materials in common use in the oil industry. The injection apparatus and system of the present invention, is constructed of any suitable material, for example stainless steel, mild carbon steel, and bellows valving, and uses pressurized nitrogen to operate the low pressure transfer system. The volume of the system should be kept as small as possible and tubing should be run to maximize drainage so residual TEB in the system is minimized. The high pressure injection system is operated by a pressure differential created in the fuel gas stream by an orifice set. Gaskets are constructed of any suitable material, for example nylon (TFE).

Having thus described a presently preferred embodiment of the present invention, it will now be appreciated that the aspects of the invention have been fully achieved, and it will be understood by those skilled in the art that many changes in construction and widely differing embodiments and applications of the invention will suggest themselves without departing from the spirit and scope of the present invention. The disclosures and the description herein are intended to be illustrative and are not in any sense limiting of the invention.

While the foregoing preferred embodiments of the invention have been described and shown, it is understood that the alternatives and modifications, such as those suggested and others, may be made thereto and fall within the scope of the invention.

I claim:

1. A method for igniting a burner using a pyrophoric liquid comprising:

transporting a quantity of pyrophoric liquid to a slug launching chamber;

transporting said quantity of pyrophoric liquid from the slug launching chamber into a fuel gas stream for said burner; and flushing said slug launching chamber with a hydrocarbon liquid to remove any of said quantity of pyrophoric liquid from said launching chamber.

2. The method of claim 1 further comprising:

venting gas from said slug launching chamber to obtain substantially atmospheric pressure in said slug launching chamber prior to said step of transporting said quantity of pyrophoric liquid to said slug launching chamber.

3. The method of claim 2 further comprising:

scrubbing said gas which is vented from said slug launching chamber to remove any traces of pyrophoric liquid therefrom.

4. The method of claim 1 wherein said quantity of pyrophoric liquid is transported to said slug launching chamber by an inert gas.

5. The method of claim 4 wherein said inert gas is nitrogen.

6. The method of claim 1 wherein said quantity of pyrophoric liquid is transported from the slug launching chamber into said fuel gas stream by means of fuel gas which is diverted from said fuel gas stream into said slug launching chamber.

7. The method of claim 6 wherein said fuel gas is diverted from said fuel gas stream by a orifice which is positioned within said fuel gas stream.

8. The method of claim 1 wherein said burner is positioned within a subterranean well and said quantity of pyrophoric liquid is transported from the slug launching chamber and into said fuel gas stream near the wellhead.

9. The method of claim 1 wherein said burner is positioned within a subterranean well and said quantity of pyrophoric liquid is transported from the slug launching chamber and into said fuel gas stream near the burner.

10. The method of claim 1 further comprising:

purging the slug launching chamber with an inert gas after said slug launching chamber is flushed with said hydrocarbon liquid.

11. An assembly for igniting a burner using a pyrophoric liquid comprising:

a conduit for transporting a fuel gas to said burner;

a chamber having an upper end and a lower end, said chamber being in fluid communication with said conduit;

a bypass loop connected to said fuel gas conduit and having an orifice positioned therein, said bypass loop being in fluid communication with said chamber; and a vessel for storing pyrophoric liquid which is in fluid communication with said chamber.

12. The assembly of claim 11 further comprising:

a first conduit having one end in fluid communication with said bypass loop on one side of the orifice and the other end in fluid communication with said chamber; and a second conduit having one end in fluid communication with said bypass loop on the other side of the orifice and the other end in fluid communication with said chamber.

13. The assembly of claim 12 wherein the other end of said first conduit is in fluid communication with said chamber at said upper end and the other end of said second conduit is in fluid communication with said chamber at said lower end.

14. The assembly of claim 12 further comprising:

a scrubber; and a third conduit for transporting a gas which is vented from said chamber to said scrubber.

15. The assembly of claim 12 further comprising:

a fourth conduit having one end connected to said chamber and the other end connected to said fuel gas conduit.

16. The assembly of claim 15 wherein said burner is positioned within a subterranean well and said fourth conduit is connected to said fuel gas conduit near the wellhead of said subterranean well.

17. The method of claim 15 wherein said burner is positioned within a subterranean well and said fourth conduit is connected to said fuel gas conduit near the burner.

18. The method of claim 15 wherein each of said fuel gas conduit, said first conduit, said second conduit, said third conduit and said fourth conduit have at least one valve therein so as to control the flow of fluid therethrough.

19. The method of claim 18 further comprising:

a programmable logic controller which is connected to each of said at least one valve so as to open or close each of said at least one valve.

* * * * *

UNITED STATES PATENT AND TRADEMARK OFFICE

CERTIFICATE OF CORRECTION

PATENT NO. : 5,832,999
DATED : November 10, 1998
INVENTOR(S) : David E. Ellwood

It is certified that error appears in the above-indentified patent and that said Letters Patent is hereby corrected as shown below:

Col. 1, line 8 : Delete "tie" and insert –the--.
Col. 2, line 61 : Delete "081308,021" and insert—08/308,021--.
Col. 6, line 41 : Delete "no-o" and insert –no-go--.
Col. 7, line 61 : Delete "8" and insert –as--.
Col. 8, line 55 : Delete "dosed" and insert –closed--.
Col. 9, line 42 : Delete "dosed" and insert –closed--.
Col. 9, line 63 : Delete "dosed" and insert –closed--.

Signed and Sealed this

Twenty-third Day of March, 1999

*Attest:*

Q. TODD DICKINSON

*Attesting Officer*

*Acting Commissioner of Patents and Trademarks*